United States Patent [19]

Olson et al.

[11] 3,978,933

[45] Sept. 7, 1976

[54] BIT-ADJACENT STABILIZER AND STEEL

[75] Inventors: Wallace Fred Olson; James Clifton McNeal, both of Midland, Tex.

[73] Assignee: Smith International, Inc., Houston, Tex.

[22] Filed: Jan. 27, 1975

[21] Appl. No.: 544,069

[52] U.S. Cl. ..... 175/325; 175/323; 308/4 A

[51] Int. Cl.[2] ..... E21B 11/00

[58] Field of Search ..... 175/325, 323, 320; 285/16, 36, 45, 333, 334; 308/4 A

[56] References Cited

UNITED STATES PATENTS

| | | | |
|---|---|---|---|
| 1,518,960 | 12/1924 | Bowser | 308/4 A |
| 1,605,316 | 11/1926 | Wilson | 308/4 A |
| 2,126,075 | 8/1938 | Wright | 175/325 |
| 2,273,017 | 2/1942 | Boynton | 285/334 X |
| 2,546,295 | 3/1951 | Boice | 308/4 A |
| 2,589,534 | 3/1952 | Buttolph | 175/325 X |
| 3,100,656 | 8/1963 | MacArthur | 285/333 X |
| 3,268,275 | 8/1966 | Laughlin | 308/4 A |
| 3,343,890 | 9/1967 | Homer | 308/4 A |
| 3,747,700 | 7/1973 | Rilling | 175/325 X |
| 3,754,609 | 8/1973 | Garrett | 175/325 X |

*Primary Examiner*—Ernest R. Purser
*Assistant Examiner*—William E. Pate, III
*Attorney, Agent, or Firm*—Murray Robinson; Ned L. Conley; David Alan Rose

[57] ABSTRACT

A replaceable stabilizer comprises a steel sleeve with fixed blades adapted to be installed over the reduced lower box end of tubular rotary drill steel member prior to insertion of the taper threaded pin of a drill bit into the taper threaded drill steel box. The drill steel member may be a special sub or a regular length of drill steel with modified lower end. An internal straight thread at the upper end of the sleeve screws onto an external straight thread on the drill steel box. An annular rubber gasket secured to the upper end of the sleeve is clamped between the upper end of the sleeve and a shoulder on the steel between the main body and the reduced box end thereof. An inturned flange at the lower end of the sleeve is clamped between a shoulder provided by the mouth of the drill steel box and a shoulder on the drill bit around its taper threaded pin. Make up of the pin and box forms a rotary shouldered connection. The outer ends of the blades are provided with tungsten carbide inserts or granular tungsten carbide hard facing is applied to the leading edge and the outer end of each blade.

14 Claims, 4 Drawing Figures

BIT-ADJACENT STABILIZER AND STEEL

CROSS REFERENCE TO RELATED APPLICATION

A companion application of Ross B. Farris, Ser. No. 542,945, filed January 22, 1975 is entitled Hammer Stabilizer, to which reference is made, especially for a discussion of some of the prior art.

BACKGROUND OF THE INVENTION

This invention relates to drill steel stabilizers useful in the rotary method of boring earth formations.

It is known to provide a rotary drill string with one or more replaceable sleeve, fixed blade type stabilizers. See for example U.S. Pat. No. 3,754,609 to Garrett, whose disclosure is incorporated herein by reference, wherein the replaceable sleeve is threaded to a special mandrel and captured between a mandrel shoulder and the shoulder formed by the mouth of a threaded box screwed onto the mandrel. Some of the relevant prior art is discussed in detail in the Garrett patent. See Also U.S. Pat. No. 2,589,534 to Buttolph wherein (FIG. 5) a replaceable sleeve 12 is screwed onto a mandrel, the lower end of the sleeve being provided with an inturned flange which engages a shoulder on a mandrel, the upper end of the sleeve being connected to the mandrel by companion grooves and locking balls. U.S. Pat. No. 2,307,688 to Larson shows a combination sucker rod guide and paraffin scraper in which a sleeve around a double pin connector is captured between shoulders on the sucker rod boxes screwed to the connector and an inturned flanges on the upper end of the sleeve engages a shoulder on the connector. U.S. Pat. No. 2,440,441-Hanes shows a replaceable wear sleeve for a tool joint wherein there are cooperating tapers on the sleeve and tool joint. U.S. Pat. No. 2,620,164 to Burris shows a key seat wiper including a sleeve mounted for axial travel on a mandrel between an upper disengaged position and a lower engaged position in which an internal spline on the sleeve engages an external spline on the mandrel. Yancey's U.S. Pat. No. 2,794,617 shows a "conventional reamer" connected just above a drill bit and just below a circulation booster. U.S. Pat. No. 2,869,827 to Cook shows a stabilizer sleeve having a retaining ring screwed into its upper end. The use of tungsten carbide inserts for wear protection of a drill pipe coupling is shown in U.S. Pat. No. 3,054,647 to Von Rosenburg. Sintered tungsten carbide hard facing for the outer periphery and leading edge of stabilizer blades is shown in the aforementioned Garrett patent. A stabilizer connected just above a tricone rock bit is shown in U.S. Pat. No. 3,370,657 to Antle. Screwed on stabilizer sleeves are shown in U.S. Pat. Nos. 1,607,941 (Bowser), 1,770,207 (Helmling), 1,803,267 (McCloskey). A rubber buffer at the lower end of a drill steel guide is shown in U.S. Pat. No. 2,177,300 to Kellegrew, the guide being just above the bit. A directive shell is shown mounted just above the drill bit in U.S. Pat. No. 2,323,027 to Gerstenkorn. Rotary shouldered connections with multiple engaged surfaces are shown in Griffin Pat. No. 2,636,753 and the references cited therein.

SUMMARY OF THE INVENTION

A replaceable stabilizer comprises a steel sleeve with fixed blades adapted to be installed over the reduced lower box end of a tubular rotary drill steel member prior to the insertion of the taper threaded pin of a drill bit into the taper threaded drill steel box. The drill steel member may be a special sub or a regular length of drill steel with modified lower end. An internal straight thread at the upper end of the sleeve screws onto an external straight thread on the drill steel box. An annular rubber gasket secured to the upper end of the sleeve is clamped between the upper end of the sleeve and a shoulder on the steel between the main body and the reduced box end thereof. An inturned flange at the lower end of the sleeve is clamped between a shoulder provided by the mouth of the drill steel box and a shoulder on the drill bit around its taper threaded pin. Make up of the pin and box forms a rotary shouldered connection. The outer ends of the blades are provided with tungsten carbide inserts or granular tungsten carbide hard facing is applied to the leading edge and the outer end of each blade.

BRIEF DESCRIPTION OF THE DRAWINGS

For a detailed description of a preferred embodiment of the invention reference will now be made to the accompanying drawings wherein.

DESCRIPTION OF PREFERRED EMBODIMENTS

Figure 1:
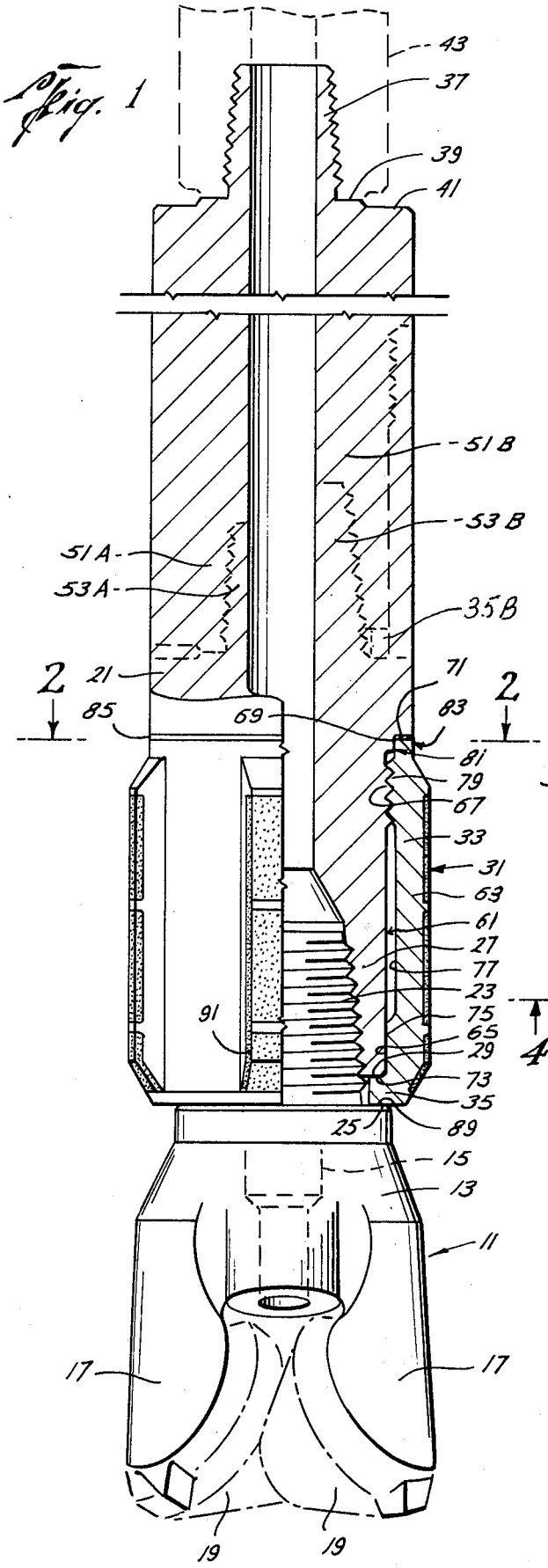
FIG. 1 is an elevation, partly in axial section through a lower drill stem assembly comprising a drill steel, a stabilizer, and a drill bit, embodying the invention.

Referring now to FIG. 1 there is shown a drill stem assembly including a conventional roller cone rock bit 11 comprising a tubular body 13 having a fluid passage 15 therethrough. A plurality of legs 17 extend downwardly from body 13. Toothed roller cones 19, providing formation disintegrating means, are rotatably mounted on legs 17. A tri-cone bit is illustrated but two-cone bits and cross section bits (four rollers) or any other form of bit (e.g. drag, diamond, etc.) could be used. A suitable bit is described in U.S. Pat. No. 2,904,374 to Boice. Commercially available bits are discessed in the 1974-75 edition of the Composite Catalogue of Oil Field Equipment and Services, at pages 4576–4578, referring to bits manufactured by Smith Tool Company. Note that although the Boice patent shows no unthreaded area between pin thread and seal shoulder, the area of unengaged threads needed for a rotary shouldered connection can be provided by an unthreaded area on the box to which the pin is connected or by an unthreaded flange as in the present invention described hereinafter.

Referring still to FIG. 1, the top of body 13 is provided with threaded tool joint means for making a rotary shouldered connection with correlative means or the lower end of drill steel (pipe) 21. In the particular example shown such connection means include on the bit a tapered threaded pin 23 and a seal shoulder 25 and on the drill steel such connection means comprise: tapered threaded box 27 whose mouth provides a sea shoulder 29. Although this is the more usual arrange ment, it would be within the scope of the invention t interchange the connection means, providing the bo: on the bit and the pin on the drill steel.

Stabilizer 31 comprises a tubular steel body or sleev 33 disposed about the lower end of drill steel 21. Sleev 33 is provided with an inturned radial flange 35. The total joint connection between the drill steel 21 and drill bit 11 is characterized by the placement of the inturned seal flange 35 between the tool joint seal shoulders 25, 29. For further details of rotary shouldered connections, and in particular of such tool joint connections in which an annular member is disposed between the tool joint shoulders, see the aforementioned Garrett patent. The flange 35 is captured between tool joint shoulders 25, 29 and seals therewith when the connection is made up tight.

Drill steel 21 is a tubular steel member of any desired length. It may, for example, be of a conventional length of seventeen or thirty two feet for a two piece drill stem or forty four feet for a single piece drill stem, both of which are typical for blast hole drilling, or it may be a special sub of one or a few feet in length adapted to be used between the bit and drill steel. It may also be a drill collar or drill pipe or sub used in oil well drilling. Typically, however, it is a joint of regular drill steel modified at its lower end to receive the stabilizer 31. Such a joint of regular drill steel may be distinguished from subs and the mandrels of conventional replaceable sleeve stabilizers by its length to diameter ratio, which is at least of the order of 10 feet (length) divided by 12 inches (diameter) equals 10. This is not a critical ratio but is a descriptive dividing line to distinguish drill steel, drill pipe, and drill collars from subs and mandrels.

Drill steel 21 is provided with tool joint connectors at its ends for making rotary shouldered connections with other drill stem members. The lower tool joint connection is box 27 and shoulder 29 previously described adapted to make up with bit 11. The upper tool joint connection includes tapered threaded pin 37 and seal shoulder 39. The annular area 41 around shoulder 39 is relieved so as not to interfere with make up with the head of a drill and to prevent the seal area from being so large as to make breakout difficult. In FIG. 1 the head 43 of the drill is indicated at dotted lines. The drill may be of any desired type suitable for rotary drilling with air or water or other fluid, e.g. as shown in U.S. Pat. No. 3,463,252 to Miller et al. or at page 5416 of the 1974-75 edition of the Composite Catalog of Oil Field Equipment and Services referring to the "Portadrill" made by Winter-Weis.

Drill steel 21 is shown to be a single piece drill stem adapted for connection at its lower end to the bit 11 and at its upper end to the drill head 43, but could be divided into a plurality of joints as is typical for drill stem used in oil well drilling. If a two piece drill stem is used, as is frequent for blast hole drilling, a tool joint connection would be employed between the two pieces as indicated in dotted lines at 51A, 53A, or at 51B, 53B. The connection 51A, 53A is similar to that at 37, 43 so that both the upper and lower pieces can be connected to the drill head. The connection at 51B, 53B is similar to that at 23, 27 so that both pieces of drill steel can be connected to the drill bit. A spacer ring 35B is substituted for flange 35. If the drill bit and drill head have like connections, then all the tool joints would be alike, which is the preferred construction. If a connection of the bit type, 51B, 53B is used in the drill stem, the lower ends of both pieces of the drill stem would be adapted to receive the stabilizer 31.

Drill steel 21 is tubular and its outer periphery is preferably cylindrical. The drill steel is reduced in diameter at its lower end and about box 27 providing a pin 61 adapted to make a rotary shouldered connection with a box 63 formed at the inner periphery of stabilizer sleeve 33. The pin 61 of this connection comprises square end shoulder 29, smooth cylindrical unthreaded area 65, straight (untapered) thread 67, smooth cylindrical land 69 and square shoulder 71. Box 63 comprises square bottom shoulder 73, smooth cylindrical unthreaded land 75, relief 77 of enlarged diameter, straight (untapered) thread 79, smooth cylindrical unthreaded area 81, and square end shoulder 83. The bottom shoulder, land, thread, and unthreaded area of the box 63 are correlative to the end shoulder, unthreaded area, thread, and land of the pin, whereby they fit together tightly with a fluid tight seal between shoulders 29 and 73. When the threads 67, 79 are made up tight the unthreaded portions of the pin and box extending from these threads to the shoulders 29, 73 are stressed so that the connection is tight. A flat elastomeric (e.g. rubber) seal ring 85 of a durometer hardness which may be of the order of 60 to 90 is clamped between shoulders 71, 83 to provide a seal therebetween without interfering with sealing engagement of shoulders 29, 73. The seal provided by the rubber ring 85 backs up the seal between shoulders 29, 73 and also keeps dirt and other foreign matter out of the threaded connection between pin 61 on the drill steel and box 63 formed in the stabilizer sleeve. This makes it easier to unscrew stabilizer sleeve 33 and replace it when necessary.

The fact that flange 35 on the stabilizer sleeve extends under the lower end of the drill steel far enough to be clamped between the drill steel and drill bit is important since it makes it possible to use the entire radial thickness of the drill steel box as a shoulder against which the flange can bear, and at the same time the area for engagement by bit shoulder 25 is not reduced, in fact the area of the shoulder 89 provided by the lower face of flange 35 for engagement with bit sholder 25 is larger than the area of shoulder 29 at the lower end of the drill steel box. As a measure of the large inward radial extent of flange 35 and its shoulder 73 it may be noted that the radial extent of the shoulder 81 may be over three times the height of the threads 79 on the stabilizer sleeve, and the radial extent of shoulder 73 is at least about twice the height of threads 79. As shown in the drawing, the inner diameter of flange 35 is about the same as the root diameter of the thread at the mouth of box 27, being larger only by the clearance necessary to receive the pin 23.

Figure 2:
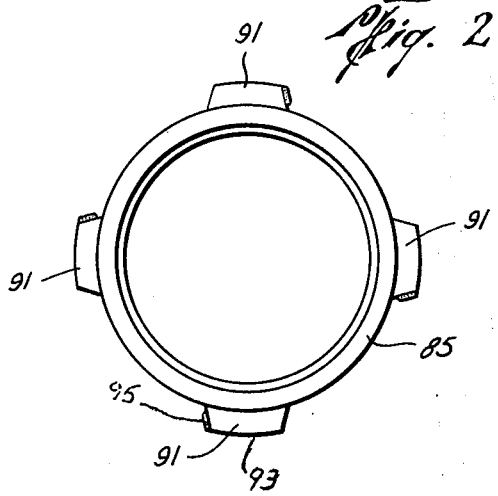
FIG. 2 shows the stabilizer of the FIG. 1 assembly, viewed from the direction 2—2 indicated in FIG. 1, i.e. a top view.
Figure 3:
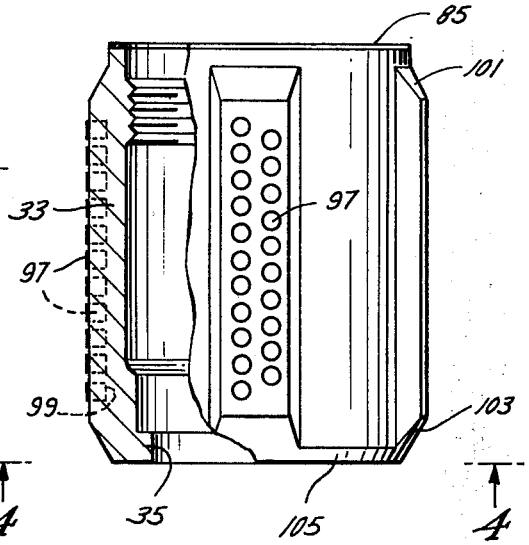
FIG. 3 is a half section of an alternate form of the stabilizer.
Figure 4:
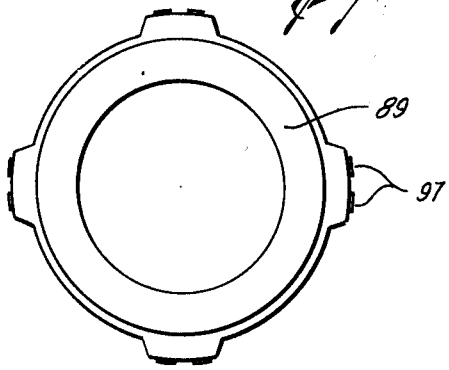
FIG. 4 is a bottom view of the stabilizer shown in FIG. 3.

Referring now also to FIG. 2, stabilizer sleeve 33 is provided with a plurality, e.g. four, of radial blades 91 for engaging the side of the hole being bored, thereby to centralize bit 11. The outer peripheries 93 of the blades and the leading edges 95 (for clockwise rotation viewed from the top) are coated with wear resistant material in the form of tungsten carbide granules. Alternatively, as shown in FIGS. 3 and 4, the blades can be provided with cylindrical tungsten carbide bodies 97 pressed into radial cylindrical holes 99 in the stabilizer blades. Except for this difference the stabilizer of FIGS. 3 and 4 is the same as that of FIGS. 1 and 2 and like parts are given like reference numbers. The upper and lower ends of the blades in both embodiments are beveled at 101, 103 (see FIG. 3) and the lower outer periphery of flange 35 is beveled at 105.

Summarizing, a drill stem assembly is provided including a stabilizer sleeve having an inturned radial flange clamped between the lower end of the drill steel and the drill bit shoulder. The sleeve can be replaced on the drill steel during a bit change without the need for special tools or additional personnel. The sleeve can be screwed on and off the drill steel using the usual tongs, wrenches, chains and the like used for making up the bit and drill steel. It is not even necessary that the stabilizer be made up on the drill steel more than hand tight since make up of the bit with the drill steel clamps the stabilizer sleeve therebetween and turning of the bit on the steel causes the sleeve to turn with the bit until the sleeve is tight on the steel. Effective stabilization is maintained at a lower cost through replacement of the sleeve alone. The support for the replaceable sleeve can be formed on the lower end of the drill steel itself eliminating the need for additional steel stock (sub) and eliminating one threaded connection (between sub and steel). The stabilization is placed directly at the bit.

While a preferred embodiment of the invention and one modification thereof have been shown and described many other modifications of the invention can be made by one skilled in the art without departing from the spirit of the invention.

We claim:

1. Drill stem assembly comprising a drill steel having a tool joint connection at one end thereof, a stabilizer sleeve around said end of the drill steel and having an inturned radial flange, and a drill bit having tool joint connection adapted to make up with the tool joint connection of the drill steel, said tool joint connections each including a threaded portion and a shoulder so as to make a rotary shouldered connection when made up, said stabilizer flange being clamped between the shoulders of said tool joint connections, said end of the drill steel being provided with a tool joint pin and the interior of the stabilizer sleeve being formed with a tool joint box engaged with said pin; said pin and box including correlative straight threads and correlative shoulders on said flange and the extremity of said end of the drill steel, said pin and box further including a smooth cylindrical land on the interior of the box between the thread and shoulder thereof and a smooth cylindrical area on the pin between the thread and shoulder thereof fitting snugly within said land.

2. Assembly according to claim 1 wherein said flange shoulder has a radial extent at least about twice the height of said straight thread thereon.

3. Assembly according to claim 1 wherein said pin and box further include a smooth cylindrical land on the pin on the side of the thread farthest from said extremity of the end of the steel and a smooth cylindrical area on the box fitting closely about the last side land.

4. Assembly according to claim 3 wherein said pin is provided with a shoulder opposite the mouth of said box and including an elastomeric seal ring clamped between said mouth and the last said shoulder.

5. Assembly acbording to claim 4 wherein said tool joint connection at the end of the drill steel to which the bit is connected is a box tool joint connection and is also formed with said pin to which the box of said stabilizer sleeve is connected.

6. Assembly according to claim 5 wherein said drill steel is a tube having a length to diameter ratio of at least ten, the other end of said drill steel being provided with means for making connection with a drill head.

7. Assembly according to claim 6 wherein said drill bit is a roller cone bit and said stabilizer sleeve has a plurality of radial blades with tungsten carbide wear resistant material on the other periphery of the blade, the radial extent of the outer peripheries of the blades being substantially equal to the radius of the hole bored by said bit.

8. Assembly according to claim 1, said drill steel comprising a tube, tool joint connections at the ends of said tube for making connections with other drill stem members, one of said connections being a box tool joint connection for making connection with a drill bit pin, said end of the drill steel that is provided with said box tool joint connection being further provided around the exterior of the box with said pin for making a rotary shouldered connection with said stabilizer sleeve.

9. Assembly according to claim 8 wherein said tube has a length to maximum outer diameter ratio of at least ten.

10. Assembly according to claim 1 wherein said sleeve has an internal relieved area of greater diameter than said land lying between said land and said thread.

11. Assembly according to claim 4 wherein said mouth of the box is a square shoulder of the same radial extent approximately as the radial extent of said flange shoulder.

12. Assembly according to claim 11 wherein said sleeve has a plurality of radial blades with tungsten carbide wear resistant material on the outer peripheries of the blades.

13. Drill stem assembly comprising a drill bit having a pin tool joint connection, a drill steel comprising a tube, and tool joint connections at the ends of said tube for making connections with other drill stem members, one of said connections being a box tool joint connection for making connection with said drill bit pin, the end of the drill steel that is provided with said box tool joint connection being further provided around the exterior of the box with a straight threaded pin for making a rotary shouldered connection with a stabilizer sleeve, a stabilizer around said pin comprising a sleeve having an internal straight thread correlative to the thread on said pin and having at one end an inturned radial flange having an inner diameter about equal to the thread root diameter of said box but large enough to receive said pin of the drill bit, said sleeve having a smooth cylindrical internal land between said internal thread and said flange, said drill steel pin having a smooth cylindrical area between said straight thread on the exterior of the pin and the mouth of said box at the end of the drill steel.

14. Stabilizer comprising an elongated tubular body whose length is greater than its outer diameter, said body having on its outer periphery a plurality of azimuthally spaced apart radial blades protected with tungsten carbide wear resistant material on the outer peripheries of the blades, said blades having a lesser axial extent than said body leaving an unbladed neck at one end forming the upper end of the stabilizer, the upper end of said neck being adapted to engage an elastomeric seal ring, said body having on its inner periphery underlying said carbide protected blades a cylindrical releived area of greater inner diameter than the inner diameter of the remainder of said inner periphry and extending axially over half the length of the body, a straight thread formed on said inner periphery between said relieved area and seal neck, a smooth cylindrical land on said inner periphery immediately below said relieved area, and an inturned radial flange at the lower end of said body providing an upwardly facing shoulder whose radial extent is at least about twice the height of said thread.

* * * * *

UNITED STATES PATENT AND TRADEMARK OFFICE

CERTIFICATE OF CORRECTION

PATENT NO. : 3,978,933

DATED : SEPTEMBER 7, 1976

INVENTOR(S) : WALLACE FRED OLSON; JAMES CLIFTON MCNEAL

It is certified that error appears in the above–identified patent and that said Letters Patent are hereby corrected as shown below:

Column 1, line 32, change "flanges" to -- flange --.

Column 2, line 45, change "discessed" to -- disclosed --.

Column 3, line 2, change "total" to -- tool --.

Column 4, line 43, change "81"to -- 89 --.

Column 5, line 57, change "ascording" to -- according --.

Column 6, line 65, change "releived" to -- relieved --

Column 6, line 67, change "periphry" to -- periphery --.

Signed and Sealed this

Fifth Day of April 1977

[SEAL]

*Attest:*

RUTH C. MASON
*Attesting Officer*

C. MARSHALL DANN
*Commissioner of Patents and Trademarks*